US011094454B2

(12) United States Patent
Iizuka et al.

(10) Patent No.: US 11,094,454 B2
(45) Date of Patent: Aug. 17, 2021

(54) NOISE REDUCTION UNIT

(71) Applicant: YAZAKI CORPORATION, Tokyo (JP)

(72) Inventors: Hayato Iizuka, Shizuoka (JP); Kazuma Kayo, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 169 days.

(21) Appl. No.: 16/016,534

(22) Filed: Jun. 22, 2018

(65) Prior Publication Data

US 2018/0374634 A1 Dec. 27, 2018

(30) Foreign Application Priority Data

Jun. 27, 2017 (JP) ..... JP2017-125076

(51) Int. Cl.

| | |
|---|---|
| ***H01F 27/02*** | (2006.01) |
| ***H01F 27/24*** | (2006.01) |
| ***H01F 27/33*** | (2006.01) |
| ***H01F 27/28*** | (2006.01) |
| ***H01F 17/06*** | (2006.01) |
| ***H01F 27/26*** | (2006.01) |

(52) U.S. Cl.

CPC ..... *H01F 27/33* (2013.01); *H01F 17/06* (2013.01); *H01F 27/02* (2013.01); *H01F 27/022* (2013.01); *H01F 27/24* (2013.01); *H01F 27/263* (2013.01); *H01F 27/2823* (2013.01); *H01F 2017/065* (2013.01)

(58) Field of Classification Search

CPC ..... H01F 27/33; H01F 17/06; H01F 27/263; H01F 27/02; H01F 27/022; H01F 27/24; H01F 27/2823; H01F 2017/065; H01F 17/062; H01F 27/306

See application file for complete search history.

(56) References Cited

U.S. PATENT DOCUMENTS

| | | | | |
|---|---|---|---|---|
| 4,329,665 | A * | 5/1982 | Kawai | H01R 13/7197 333/182 |
| 7,012,496 | B2 * | 3/2006 | Sugiura | H01F 17/062 336/174 |
| 9,815,421 | B2 * | 11/2017 | Yamaguchi | H01F 17/062 |
| 2004/0085174 | A1 | 5/2004 | Decristofaro et al. | |
| 2006/0066433 | A1 | 3/2006 | Decristofaro et al. | |
| 2013/0039815 | A1 | 2/2013 | Murata | |

(Continued)

FOREIGN PATENT DOCUMENTS

| | | |
|---|---|---|
| CN | 101027733 A | 8/2007 |
| CN | 204407124 U | 6/2015 |

(Continued)

*Primary Examiner* — Tuyen T Nguyen

(74) *Attorney, Agent, or Firm* — Kenealy Vaidya LLP

(57) ABSTRACT

A noise reduction unit includes a conductor having a winding portion and a ring-shaped core which is made of a magnetic material and is inserted through the winding portion, and a housing which houses the conductor and the ring-shaped core. An inner wall surface of the housing is formed with a recess configured to receive a part of the winding portion located on an outer circumferential surface of the ring-shaped core. The conductor is housed in the housing so that the part of the winding portion is received in the recess.

9 Claims, 5 Drawing Sheets

(56) References Cited

U.S. PATENT DOCUMENTS

| | | | | |
|---|---|---|---|---|
| 2014/0217642 | A1* | 8/2014 | Suzuki | H01F 27/306 264/259 |
| 2017/0174152 | A1 | 6/2017 | Yamaguchi et al. | |
| 2018/0304826 | A1* | 10/2018 | Yahagi | B60R 16/02 |

FOREIGN PATENT DOCUMENTS

| | | | | |
|---|---|---|---|---|
| JP | 9-18185 | A | | 1/1997 |
| JP | 2002-57541 | A | | 2/2002 |
| JP | 2004253500 | A | * | 9/2004 |
| JP | 2006-147796 | A | | 6/2006 |
| JP | 4369167 | B2 | | 11/2009 |
| JP | 2013229406 | A | * | 11/2013 |
| JP | 2017-112064 | A | | 6/2017 |

* cited by examiner

NOISE REDUCTION UNIT

CROSS REFERENCE TO RELATED APPLICATIONS

This application is based on Japanese Patent Application (No. 2017-125076) filed on Jun. 27, 2017, the contents of which are incorporated herein by reference.

BACKGROUND OF THE INVENTION

1. Field of the Invention

The present invention relates to a noise reduction unit.

2. Description of the Related Art

Noise reduction units are known which are equipped with a ring-shaped core that is a circular magnetic body having an insertion hole through which an electric wire is inserted and a case that houses the ring-shaped core. Noise reduction units of this type can reduce noise occurring in the electric wire by absorbing, with the ring-shaped core, high-frequency noise such as a surge current flowing through the electric wire inserted through the insertion hole of the ring-shaped core (refer to JP-B-4369167, for example).

In actuality, conventional noise reduction units of the above type are used in such a manner that a case-incorporated ring-shaped core in which a case is attached to a ring-shaped core in advance is attached to an electric wire (from outside). On the other hand, noise reduction units of another type are known which are produced in such a manner that a conductor is wound on a ring-shaped core in advance and the ring-shaped core and the conductor are housed in a case (housing) together. In noise reduction units of this type, electric wires are connected to the conductor that is housed (incorporated) in the noise reduction unit.

Incidentally, in noise reduction units of the latter type, in incorporating the ring-shaped core and the conductor into the housing, it is desirable that the ring-shaped core and the conductor be able to be positioned easily in the housing to, for example, increase the efficiency of assembling work.

SUMMARY OF THE INVENTION

The present invention has been made in view of the above circumstances, and an object of the invention is therefore to provide a noise reduction unit that is superior in the efficiency of assembling work.

To attain the above object, the invention provides noise reduction units of the following items (1) to (3):

(1) A noise reduction unit including:

a conductor having a winding portion;

a ring-shaped core which is made of a magnetic material and is inserted through the winding portion; and a housing which houses the conductor and the ring-shaped core, wherein a n inner wall surface of the housing is formed with a recess configured to receive a part of the winding portion located on an outer circumferential surface of the ring-shaped core; and wherein the conductor is housed in the housing so that the part of the winding portion is received in the recess.

(2) The noise reduction unit according to item (1), wherein the conductor and the ring-shaped core are sealed in the housing with a resin; and wherein the resin fills a gap which exists between the part and the recess with the resin.

(3) The noise reduction unit according to item (1) or (2), wherein the ring-shaped core is configured by a first divisional core and a second divisional core which are assembled to each other; and wherein the winding portion of the conductor is wound on only the first divisional core.

According to the noise reduction unit having the configuration of item (1) or (3), when the combination of the ring-shaped core and the conductor (hereinafter referred to as a "noise filter" for the sake of convenience) is housed in the housing, the noise filter can be positioned with respect to the housing by setting the outside portion, located on the outside circumferential surface of the ring-shaped core, of the winding portion in the recess of the housing. As such, the noise reduction unit having this configuration is higher in the efficiency of assembling work than in a case the housing does not have such a recess.

The noise reduction unit having this configuration provides an advantage that is different from the above advantage. More specifically, since the outside portion of the winding portion is set in the recess, the noise reduction unit can be made smaller (lower in height) than in a case that the housing is not formed with the recess. In other words, this noise reduction unit can be miniaturized while its noise reducing function is kept unchanged.

According to the noise reduction unit having the configuration of item (2), since the part of the winding portion is received in the recess of the housing, a phenomenon can be suppressed that the position of the noise filter is deviated being pushed by the sealing resin when the sealing resin is injected into the housing.

Furthermore, since the resin goes into gaps between the outside portion of the winding portion that is set in the recess and wall surfaces of the recess, the resin comes into contact with the housing with a wider contact area than in a case that the housing is not formed with the recess. This makes the heat transfer between the resin and the housing easier. And the heat transfer between the conductor and the housing (and hence between the noise filter and the housing) via the resin is made easier. As a result, the heat dissipation performance of the noise filter having this configuration can be enhanced.

The invention can provide a noise reduction unit that is superior in the efficiency of assembling work.

The invention has been described above concisely. The details of the invention will become more apparent when the modes for carrying out the invention (hereinafter referred to as an embodiment) described below are read through with reference to the accompanying drawings.

DETAILED DESCRIPTION OF THE EXEMPLARY EMBODIMENTS

A noise reduction unit according to an embodiment of the present invention will be hereinafter described with reference to the drawings.

Figure 1:
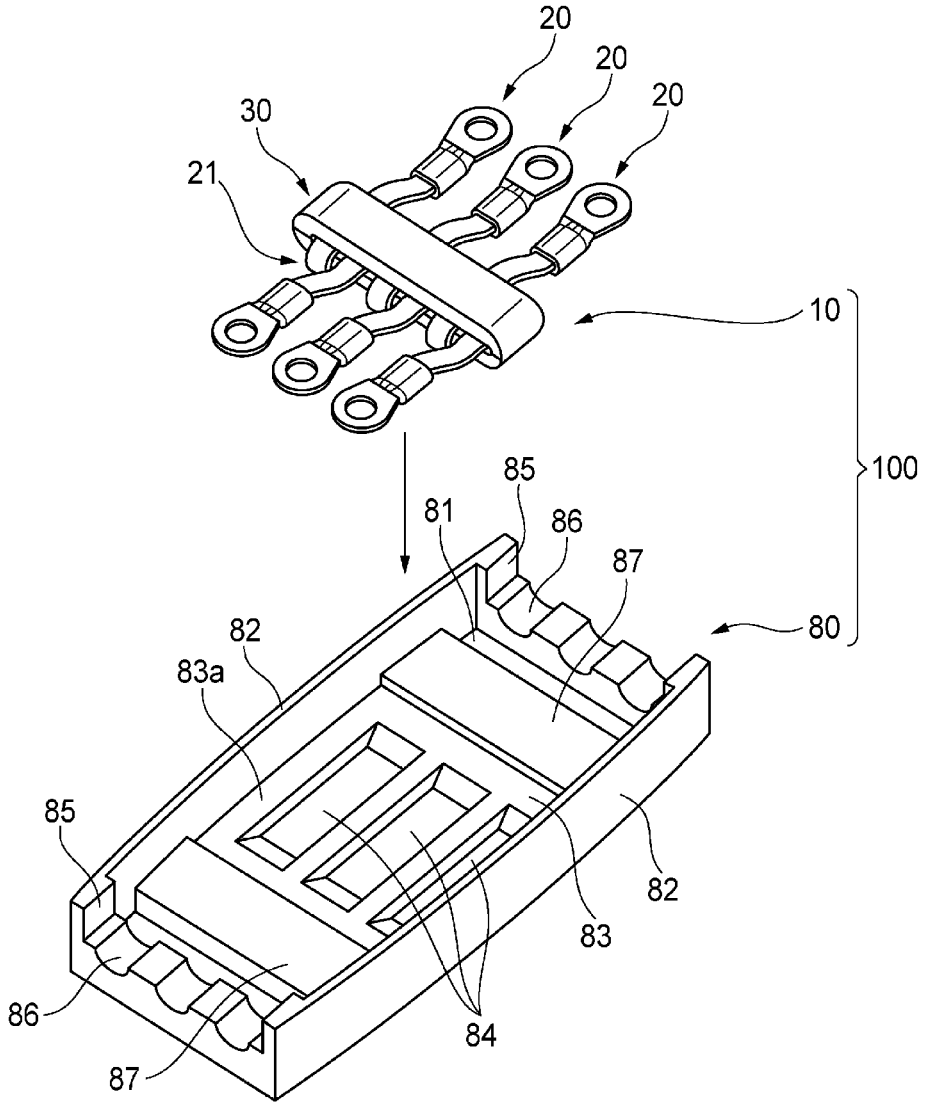
FIG. 1 is an exploded perspective view of a noise reduction unit according to an embodiment of the present invention.

As shown in FIG. 1, a noise reduction unit 100 according to the embodiment is equipped with a noise filter 10 and a housing 80 which houses the noise filter 10. First, the noise filter 10 will be described by mainly referring to FIGS. 2A and 2B, 3, and 5.

Figure 2A:
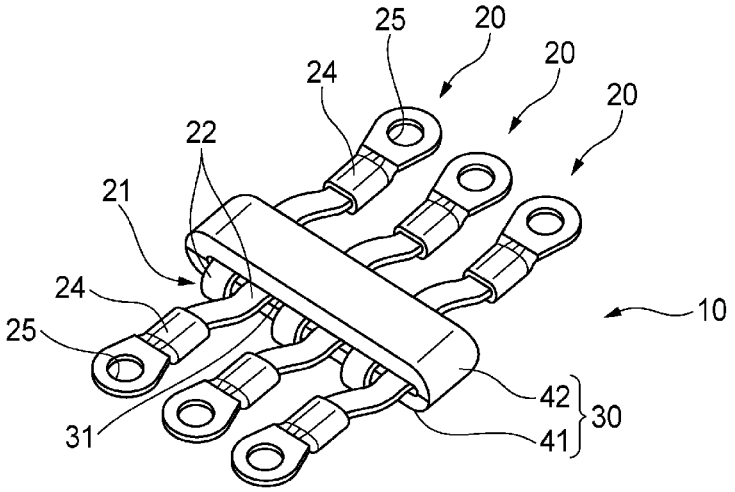
FIGS. 2A and 2B are perspective views, as viewed from the front side and the rear side, respectively, of a noise filter shown in FIG. 1.
Figure 2B:
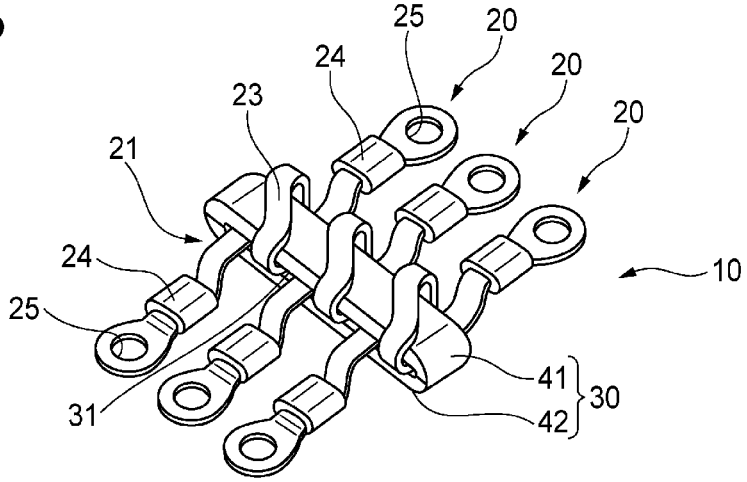
Figure 3:
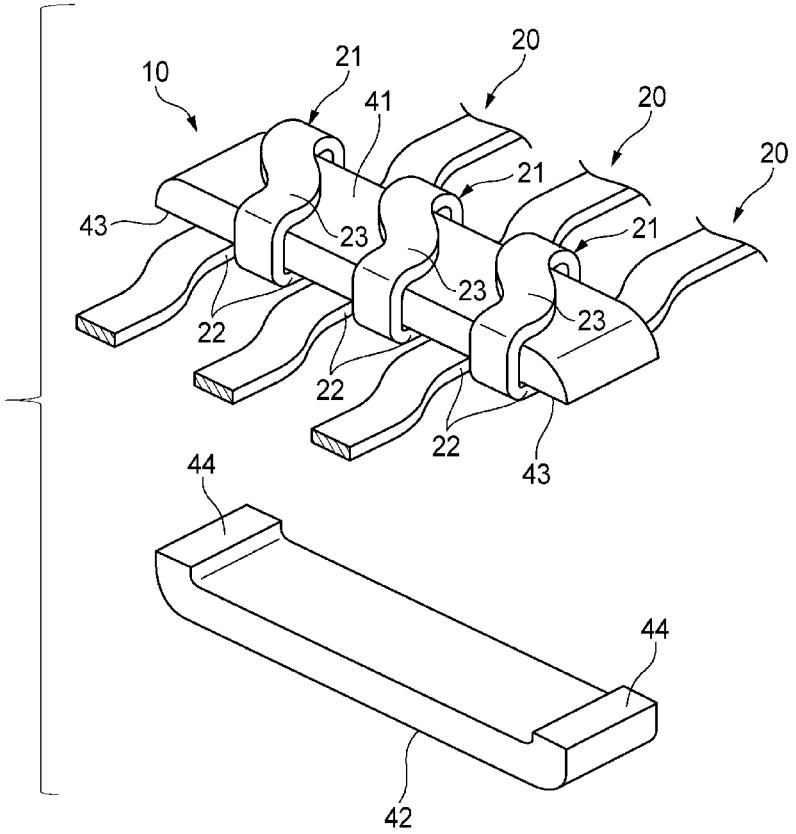
FIG. 3 is an exploded perspective view of the noise filter shown in FIG. 1.

As shown in FIGS. 2A and 2B and FIG. 3, the noise filter 10 has plural (in this example, three) conductors 20 and a ring-shaped core 30. For example, the noise filter 10 is provided for a wire harness that connects an inverter and a motor of an electric vehicle, a hybrid car, or the like. The inverter converts a DC voltage of a power source such as a battery into an AC voltage and thereby drives the motor for rotating wheels. Since the inverter converts a DC voltage into an AC voltage by high-speed switching, a high-frequency surge current generated by the switching may flow through wires of the wire harness. Provided in the wire harness that connects the inverter and the motor, the noise filter 10 reduces noise generated by the switching.

Originally, the conductors 20 are flat-plate-like busbars produced by, for example, punching a conductive metal plate into strips. A middle portion of each conductor 20 is made a ring-shaped winding portion 21 that is formed by, for example, bending so as to project in the vertical direction. The winding portion 21 is inclined in a plan view, whereby end portions 22 (see FIGS. 2A and 3) of the winding portion 21 are deviated (i.e., spaced) from each other in the width direction in a plan view so as not to be in contact with each other.

In the following description, for convenience of description, a portion opposite to the end portions 22 in a radial direction of the winding portion 21, of the winding portion 21 will be referred as a projection portion 23 (see FIGS. 2B and 3). As shown in FIGS. 2B and 3, it can be said that the projection portion 23 of the winding portion 21 is a portion, located on an outer circumferential surface of the ring-shaped core 30, of the winding portion 21.

Terminals 24 are fixed to two respective end portions of each conductor 20. Each terminal 24 has a bolt insertion hole 25 and is fixed to the associated conductor 20 by, for example, crimping and thereby connected to it electrically. The terminals 24 (and the bolt insertion holes 25) of each conductor 20 are used for connection to wires of a wire harness (described later with reference to FIG. 4).

For example, the ring-shaped core 30 is made of a magnetic material such as ferrite. The ring-shaped core 30 is shaped like a flat ring having an insertion passage 31 (see FIGS. 2A and 2B and FIG. 5) which is an elliptical hole. The insertion passage 31 of the ring-shaped core 30 is a little greater in height than the thickness of the conductors 20.

The ring-shaped core 30 is configured by a pair of divisional cores 41 and 42. The flat-ring-shaped core 30 having the insertion passage 31 is formed by combining together the divisional cores 41 and 42 that are set vertically.

Each of the divisional cores 41 and 42 extends straightly. The plural conductors 20 are wound on the one divisional core 41 which is set on one side in the vertical direction, so as to be arranged in a row (see FIGS. 2B and 3). The end portions 22 of the winding portion 21 of each conductor 20 that is wound on the divisional core 41 are inserted in the insertion passage 31 (see FIGS. 2A and 5).

As shown in FIG. 3, surface portions 43, located at the two respective ends in the width direction and facing the other divisional core 42, of the one divisional core 41 are joining surfaces (flat surfaces) 43. And two end portions, in the width direction, of the other divisional core 42 project toward the one divisional core 41 and end surfaces of the projected portions are joining surfaces (flat surfaces) 44.

The divisional cores 41 and 42 are joined to each other by bringing each pair of joining surfaces 43 and 44 into contact with each other. Each pair of joining surfaces 43 and 44 of the divisional cores 41 and 42 are bonded to each other by a magnetic adhesive member (not shown) that is in paste or sheet form and is provided between the joining surfaces 43 and 44. The magnetic adhesive member is given magnetism by containing a magnetic material such as a ferrite powder. In this manner, a ring-shaped magnetic path is formed by the divisional cores 41 and 42 that are bonded to each other.

How to assemble the noise filter 10 which is configured as described above will be described below briefly.

To assemble the noise filter 10, first, plural conductors 20 having respective winding portions 21 are prepared. Then, as shown in FIG. 3, the plural conductors 20 are attached to the one divisional core 41 of a ring-shaped core 30. More specifically, the divisional core 41 that is oriented so that the joining surfaces 43 are located on the bottom side is inserted into the winding portions 21 of the conductors 20 that are oriented so that the projection portions 23 of the winding portions 21 are located on the top side. As a result, the conductors 20 are wound on the one divisional core 41 so as to be arranged in a row.

Subsequently, a magnetic adhesive member is applied to one or both of each pair of joining surfaces 43 and 44 of the divisional cores 41 and 42 and each pair of joining surfaces 43 and 44 of the divisional cores 41 and 42 are brought into contact with each other. As a result, each pair of joining surfaces 43 and 44 of the divisional cores 41 and 42 are bonded to each other by the adhesive member, whereby the divisional cores 41 and 42 are integrated with each other into a ring-shaped core 30.

In this manner, a noise filter 10 is formed in which the plural conductors 20 are attached to the ring-shaped core 30 which is composed of the pair of divisional cores 41 and 42. The thus-produced noise filter 10 can reduce noise by means of the ring-shaped core 30 having a ring-shaped magnetic path when currents flow through the conductors 20.

The noise filter 10 has been described above. Next, the housing 80 which houses the noise filter 10 will be described by mainly referring to FIGS. 1, 4, and 5.

As shown in FIG. 1, the housing 80 is made of an insulative synthetic resin and has a bottom plate 81 and side walls 82 which are erected from the bottom plate 81 at the two respective sides in the width direction. The housing 80 is shaped like a rectangular box having a housing space that is open at the top. A central portion of the bottom plate 81 is a core holding portion 83 which defines a central portion of the housing space in which to set the noise filter 10 (see FIGS. 4 and 5).

The top surface (flat surface; see FIG. 5)) 83*a* of the core holding portion 83 is formed with plural (in this embodiment, three) recesses 84 which extend in the longitudinal direction and are arranged in the width direction at intervals. Each recess 84 is shaped so as to be able to receive the projection portion 23 of the winding portion 21 of a conductor 20. A rib 83*b* which extends in the longitudinal direction (see FIG. 5) is formed between adjacent recesses 84 which are formed in the above manner.

The housing 80 has wire introduction portions 85 at the two respective ends in the longitudinal direction. As described later, the wire introduction portions 85 are portions from which to introduce wires 1 of a wire harness (see FIG. 4). Each wire introduction portion 85 is formed with plural (in this embodiment, three) U-shaped wire holding grooves 86 which are spaced from each other in the width direction. The bottom plate 81 is formed with, between the core holding portion 83 and the wire introduction portions 85, terminal stages 87 which project from the level of the top surface 83*a* of the core holding portion 83. Insert nuts (not shown) are buried in the terminal stages 87 by insert molding, for example.

A procedure for housing the completed noise filter 10 in the above-configured housing 80 will be described below briefly. To house the noise filter 10 in the housing 80, first, as shown in FIG. 1, the ring-shaped core 30 of the noise filter 10 is brought close to the core holding portion 83 of the housing 80 with the projection portions 23 of the winding portions 21 of the respective conductors 20 down (i.e., the noise filter 10 is oriented so that the projection portions 23 are opposed to the core holding portion 83 of the housing 80).

Figure 5:
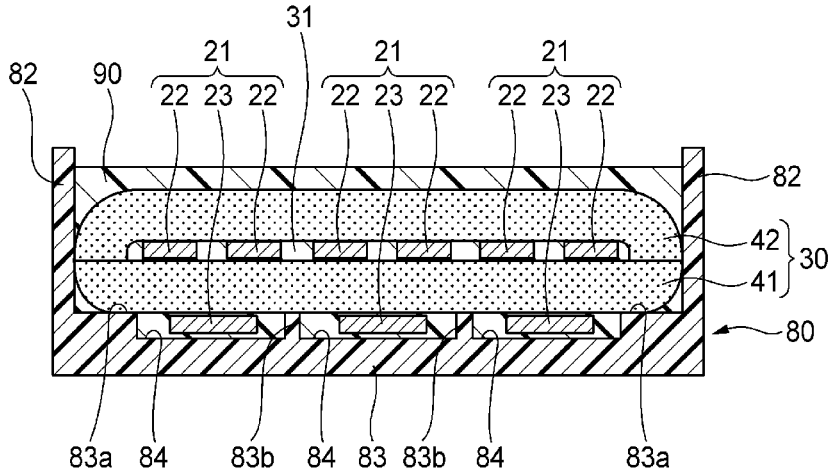
FIG. 5 is a sectional view taken along line A-A in FIG. 4.

Then the ring-shaped core 30 is placed on the top surface 83*a* of the core holding portion 83 in such a manner that the projection portions 23 of the winding portions 21 are set in the respective recesses 84 of the core holding portion 83 (see FIG. 5). As a result, the terminals 24 which are fixed to the respective conductors 20 of the noise filter 10 are placed on top of the terminal stages 87, more specifically, over the respective insert nuts.

As shown in FIG. 5, in a state that the ring-shaped core 30 is placed on the top surface 83*a* of the core holding portion 83, each rib 83*b* of the core holding portion 83 is located between adjacent projection portions 23 of the winding portions 21 in the width direction. In addition, gaps are formed between each projection portion 23 and the side wall surfaces of the associated recess 84. That is, each projection portion 23 is not in contact with the side wall surfaces of the associated recess 84. The projection portions 23 are set in the respective recesses 84 in this manner, whereby the noise filter 10 is positioned with respect to the housing 80.

Subsequently, as shown in FIG. 5, a sealing material 90 which is a synthetic resin such as an epoxy resin is charged into the housing 80 in which the ring-shaped core 30 is placed on the top surface 83*a* of the core holding portion 83. At this time, since the projection portions 23 of the conductors 20 are set in the respective recesses 84 of the housing 80, a phenomenon can be prevented that the position of the noise filter 10 is deviated being pushed by the sealing material 90 being charged. For example, the sealing material 90 is charged to the level of the top surfaces of the terminal stages 87. As shown in FIG. 5, charged in this manner, the sealing material 90 also goes into the gaps between each projection portion 23 and the wall surfaces of the associated recess 84.

By charging the sealing material 90 into the housing 80 in the above-described manner, the noise filter 10 having the ring-shaped core 30 made of a magnetic material can be fixed and protected reliably and can be increased in impact resistance. And the noise reduction unit 100 can be miniaturized because it no longer requires a complex waterproof structure. The waterproofness of the noise reduction unit 100 can be made even so high that it can be installed outside the vehicle body by putting a lid on top of the housing 80. The noise reduction unit 100 in which the noise filter 10 is housed in and fixed to the housing 80 can thus be obtained.

Figure 4:
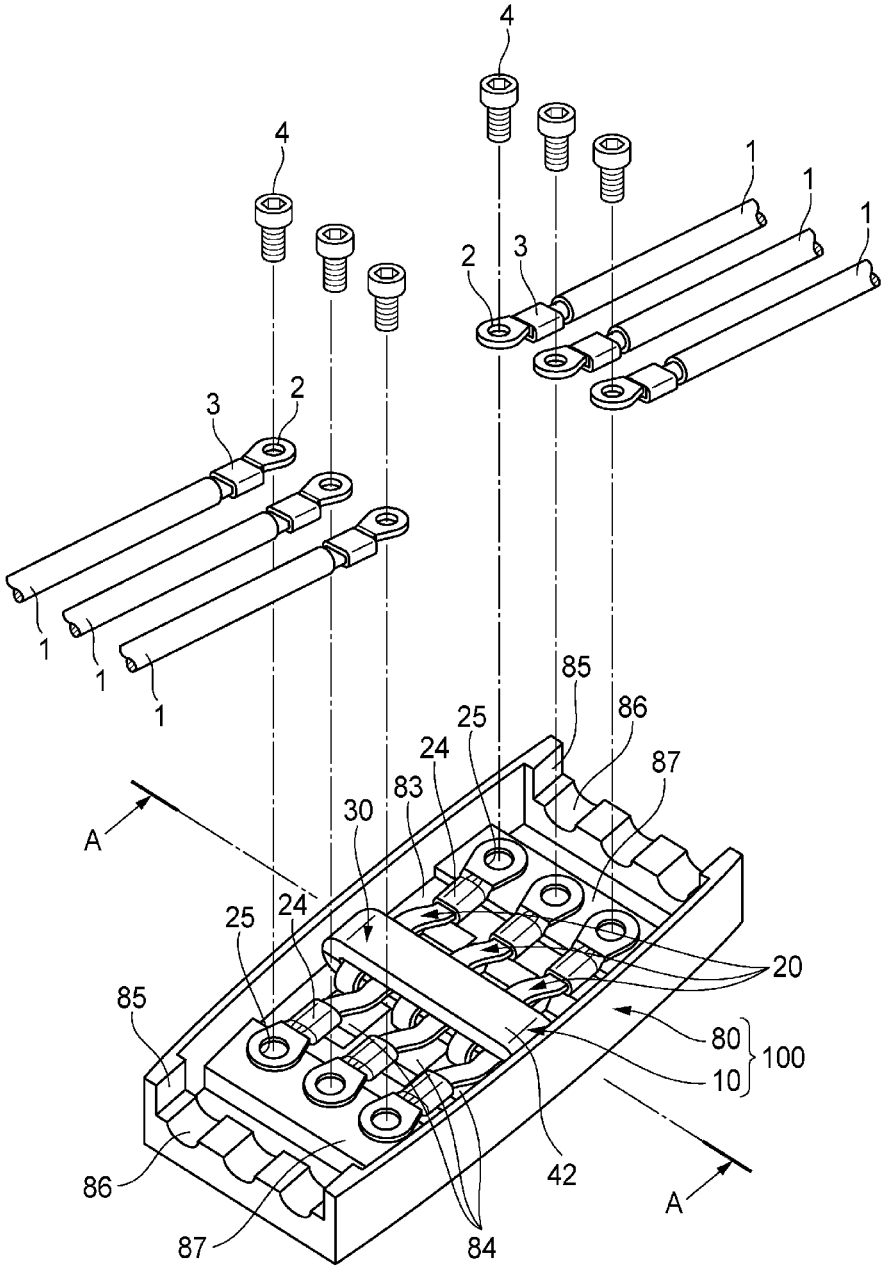
FIG. 4 is a perspective view illustrating a procedure according to which wires of a wire harness are attached to the noise reduction unit according to the embodiment.

For example, as shown in FIG. 4, wires 1, extending from an inverter and a motor, of a wire harness are connected to the above-configured noise reduction unit 100. A terminal 3 having a bolt insertion hole 2 at one end is connected to each wire 1. Each wire 1 is introduced through a wire introduction portion 85 of the housing 80 and is set and held in a wire holding groove 86. The terminal 3 of each wire 1 is placed on the terminal 24 of the corresponding conductor 20 that is placed on top of the associated terminal stage 87, whereby the bolt insertion holes 2 and 25 communicate with each other. A bolt 4 is inserted into these bolt insertion holes 2 and 25 and screwed into the associated insert nut of the terminal stage 87, whereby the terminal 3 of the wire 1 and the terminal 24 of the conductor 20 are fastened to the terminal stage 87 and electrically connected to each other. In this manner, the wires 1, extending from the inverter and the motor, of the wire harness are connected to the noise reduction unit 100 and noise generated by high-speed switching in the inverter can be reduced by the noise filter 10 of the noise reduction unit 100.

According to the above-described noise reduction unit 100 having the noise filter 10, when it is inserted between, for example, wires extending from an inverter and a motor, of a wire harness, noise that is generated by high-speed switching in the inverter can be reduced satisfactorily. Since the noise filter 10 which is low in height is housed in the housing 80, the noise reduction unit 100 is reduced in height and hence can be installed in a narrow space. For example, the noise reduction unit 100 which is connected to a wire harness of a vehicle or the like at its halfway position can be fixed to a floor panel of the vehicle. Furthermore, the noise filter 10 having the ring-shaped core 30 made of a magnetic material can be protected by the housing 80.

As described above, according to the noise reduction unit 100 of the embodiment, when the noise filter 10 is housed in the housing 80, the noise filter 10 can be positioned with respect to the housing 80 by setting the projection portions 23 of the winding portions 21 in the respective recesses 84 of the housing 80. As such, the noise reduction unit 100 having the above configuration is superior in the efficiency of assembling work.

Since the projection portions 23 of the winding portions 21 are set in the respective recesses 84, the noise reduction unit 100 can be made smaller (lower in height) than in a case that the housing 80 is not formed with the recesses 84.

Since the projection portions 23 of the winding portions 21 are set in the respective recesses 84 of the housing 80 when the noise filter 10 is sealed in the housing 80 with the sealing material 90, the position of the noise filter 10 is not deviated being pushed by the sealing material 90 when it is injected into the housing 80.

Furthermore, since the sealing material 90 goes into the gaps between the projection portion 23 of each winding portion 21 that is set in the associated recess 84 and the side wall surfaces of the recess 84, the sealing material 90 comes into contact with the housing 80 with a wider contact area than in a case that the housing 80 is not formed with the recesses 84. This makes the heat transfer between the sealing material 90 and the housing 80 easier. And the heat transfer between the conductors 20 and the housing 80 (and hence between the noise filter 10 and the housing 80) via the sealing material 90 is made easier. As a result, the heat dissipation performance of the noise filter 10 can be enhanced.

<Other Modes>

The invention is not limited to the above embodiment and various modifications, improvements, etc. can be made as appropriate within the scope of the invention. The materials, shapes, sets of dimensions, numbers, locations, etc. of the respective constituent elements of the above embodiment are not limited to those disclosed but can be determined in desired manners as long as the invention can be implemented.

For one thing, although in the above embodiment the conductors 20 of the noise filter 10 are flat-plate-like busbars, the conductors 20 may be, for example, insulated electric wires in each of which a core wire is covered with an outer sheath.

It suffices that at least the one divisional core 41, inserted through the winding portions 21 of the conductors 20, of the ring-shaped core 30 be straight; the other divisional core 42 need not always be straight and may be curved, for example.

Although in the above embodiment the ring-shaped core 30 is the combination of the pair of (i.e., top and bottom) divisional cores 41 and 42, the ring-shaped core 30 may be a combination of a pair of divisional cores that are attached to each other in the horizontal direction. As a further alternative, the ring-shaped core 30 may be of a unitized (i.e., non-divisional) type, instead of the divisional type (a combination of a pair of divisional cores).

Features of the above-described noise reduction unit 10 according to the embodiment of the invention will be summarized below concisely as items (1) and (2):

(1) A noise reduction unit (100) including:

a conductor (20) having a winding portion (21);

a ring-shaped core (30) which is comprised of a magnetic material and is inserted through the winding portion (21); and a housing (80) which houses the conductor (20) and the ring-shaped core (30), wherein an inner wall surface (83*a*) of the housing (80) is formed with a recess (84) configured to receive a part (23) of the winding portion located on an outer circumferential surface of the ring-shaped core (30); and wherein the conductor (20) is housed in the housing (80) so that the part (23) of the winding portion (21) is received in the recess (84).

(2) The noise reduction unit (100) according to item (2), wherein the conductor (20) and the ring-shaped core (30) are sealed in the housing (80) with a resin (90), and the resin (90) exists between the outside portion (23) and wall surfaces of the recess (84).

What is claimed is:

1. A noise reduction unit comprising:

a plurality of conductors, each of the conductors being formed as a busbar and having a winding portion;

a ring-shaped core which is comprised of a magnetic material and is inserted through each of the winding portions; and a housing which houses the conductors and the ring-shaped core, wherein an inner wall surface of the housing is formed with a plurality of recesses spaced apart from each other along the inner wall surface, and the recesses are configured to receive a part of a respective one of the winding portions located on an outer circumferential surface of the ring-shaped core;

wherein the conductors are housed in the housing so that the part of a respective one of the winding portions is received in a respective one of the recesses, wherein the ring-shaped core is configured by a first divisional core and a second divisional core which are assembled to each other, wherein the winding portion of each of the conductors is wound on only the first divisional core, wherein the conductors are spaced apart from each other, and wherein the recesses are provided on the inner wall surface of the housing so that the part of the respective one of the winding portions which protrudes in a direction in which the first divisional core and the second divisional core are arranged is received in the respective one of the recesses.

2. The noise reduction unit according to claim 1, wherein the plurality of conductors and the ring-shaped core are sealed in the housing with a resin; and wherein the resin fills a respective gap which exists between the part of the respective one of the windings and the respective one of the recesses with the resin.

3. The noise reduction unit according to claim 1, wherein each of the conductors is a flat-plate-like busbar.

4. The noise reduction unit according to claim 3, wherein each of the recesses is shaped differently from the part of the respective one of the windings.

5. The noise reduction unit according to claim 4, wherein each of the winding portions is entirely beneath a top surface of the inner wall surface of the housing in the vertical direction.

6. The noise reduction unit according to claim 5, wherein the inner wall surface of the housing is formed with the recesses disposed between terminal stages which project from the top surface of the inner wall surface of the housing.

7. The noise reduction unit according to claim 3, wherein the inner wall surface of the housing is formed with each of the recesses having a flat bottom.

8. The noise reduction unit according to claim 1, wherein each of the winding portions has end portions spaced from each other in a width direction.

9. The noise reduction unit according to claim 8, further comprising:

terminals fixed to respective end portions of each of the conductors.

* * * * *